US006155501A

United States Patent [19]

Giannotti et al.

[11] Patent Number: 6,155,501

[45] Date of Patent: Dec. 5, 2000

[54] COLLIDING-JET NOZZLE AND METHOD OF MANUFACTURING SAME

[75] Inventors: Hugo Giannotti, E. Patchogue; Geoffrey S. Giannotti, Bellport; Richard Paccione, N. Mussapequa, all of N.Y.

[73] Assignee: MarketSpan Corporation, Hicksville, N.Y.

[21] Appl. No.: 09/174,526

[22] Filed: Oct. 16, 1998

Related U.S. Application Data

[60] Provisional application No. 60/062,327, Oct. 17, 1997.

[51] Int. Cl.[7] ..... B05B 1/26

[52] U.S. Cl. ..... 239/545; 239/543

[58] Field of Search ..... 239/1, 418, 518, 239/521, 543, 544, 545, 209, 550, 565; 29/890.142

[56] References Cited

U.S. PATENT DOCUMENTS

| | | | |
|---|---|---|---|
| Re. 33,841 | 3/1992 | Rush et al. . | |
| 572,780 | 12/1896 | Ulbrich | 239/545 |
| 605,868 | 6/1898 | Grimm et al. . | |
| 629,181 | 7/1899 | Ulbrich | 239/545 |
| 640,887 | 1/1900 | Dolan | 239/545 |
| 1,075,678 | 10/1913 | Wall . | |
| 1,184,248 | 5/1916 | Lindekugel . | |
| 1,239,230 | 9/1917 | Shaw | 239/545 |
| 1,712,326 | 5/1929 | Brock . | |
| 2,410,215 | 10/1946 | Houghton . | |
| 2,532,711 | 12/1950 | Goddard . | |
| 2,540,663 | 2/1951 | Garey . | |
| 2,553,562 | 5/1951 | Evans . | |
| 2,755,135 | 7/1956 | Gusching . | |
| 2,770,501 | 11/1956 | Coanda . | |
| 2,785,926 | 3/1957 | Lataste . | |
| 2,928,611 | 3/1960 | Lauderback et al. . | |
| 3,093,315 | 6/1963 | Tachiki et al. . | |
| 3,125,298 | 3/1964 | Iwata . | |
| 3,342,193 | 9/1967 | Deering et al. . | |
| 3,539,102 | 11/1970 | Lang . | |
| 3,590,924 | 7/1971 | Emmons et al. . | |
| 3,622,080 | 11/1971 | Greenwood . | |
| 3,642,211 | 2/1972 | Place . | |
| 3,675,855 | 7/1972 | Harwood et al. . | |
| 4,002,293 | 1/1977 | Simmons . | |
| 4,085,171 | 4/1978 | Baker et al. . | |
| 4,155,700 | 5/1979 | Babington . | |
| 4,195,782 | 4/1980 | Troup . | |
| 4,266,951 | 5/1981 | Calvert . | |
| 4,289,104 | 9/1981 | Takada et al. . | |
| 4,640,460 | 2/1987 | Franklin, Jr. . | |
| 4,783,008 | 11/1988 | Ikeuchi et al. . | |
| 4,943,007 | 7/1990 | Bowe et al. | 239/589.1 |
| 4,994,517 | 2/1991 | Vohrer . | |
| 5,080,286 | 1/1992 | Morrison . | |
| 5,244,149 | 9/1993 | Yuan et al. . | |

(List continued on next page.)

FOREIGN PATENT DOCUMENTS

| | | |
|---|---|---|
| 1253929 | 1/1961 | France . |
| 475464 | 4/1929 | Germany . |
| 1570788 | 6/1990 | U.S.S.R. . |
| 29349 | of 1910 | United Kingdom . |
| WO 96/14941 | 5/1996 | WIPO . |

*Primary Examiner*—Andres Kashnikow
*Assistant Examiner*—Steven J. Ganey
*Attorney, Agent, or Firm*—Dilworth & Barrese, LLP

[57] ABSTRACT

The colliding-jet nozzle which includes a nozzle body portion having a proximal end, a distal end and a fluid inlet defined partially therethrough. The body portion also includes first and second outlet ports disposed through the nozzle body portion for directing fluid from the inlet outwardly therefrom. A proximal end of a first hollow tube is attached and in fluid communication with the first outlet port and a distal end of the first hollow tube extends outwardly therefrom. A first end of a second hollow tube is attached and in fluid communication with the second outlet port and a second end of the second hollow tube is axially aligned with the distal end of the first hollow tube to define a gap therebetween such that fluid exiting from the first outlet port and fluid exiting from the second outlet port directly collide with each other to atomize fluid.

15 Claims, 15 Drawing Sheets

U.S. PATENT DOCUMENTS 5,358,179 10/1994 Lund et al. .
5,383,597 1/1995 Sooriakumar et al. .
5,472,143 12/1995 Bartels et al. .
5,484,107 1/1996 Holmes .
5,523,063 6/1996 Anderson .
5,525,268 6/1996 Reens ..... 239/61 X
5,540,200 7/1996 Naitoh et al. .
5,586,726 12/1996 Furuya et al. .

3001

3002

3003

1501

1502

1503

501A

COLLIDING-JET NOZZLE AND METHOD OF MANUFACTURING SAME

RELATED APPLICATION

This application claims the benefit of provisional application Ser. No. 60/062,327 entitled "COLLIDING-JET NOZZLE" filed on Oct. 17, 1997.

BACKGROUND OF THE DISCLOSURE

1. Technical Field

The present disclosure relates to fluid distribution apparatii, and more specifically to a nozzle designed to disperse a fluid by causing a collision of two streams of the fluid.

2. Description of the Related Art

There are presently many known piping and/or nozzle designs which produce a distribution of droplets as a result of fluid dispersion. For example, U.S. Pat. No. 629,181 to Ulbrich discloses a spray nozzle for use in humidifiers. The Ulbrich 181 nozzle develops moisture which is typically used in maintaining the proper moisture in the atmosphere of rooms. Also, U.S. Pat. No. 2,410,215 to Houghton discloses an apparatus which directs fluid through two C-shaped piping assemblies such that the fluid exits from nozzles which are in directly opposing axial alignment. Typical applications include humidifiers, fog dissipation, washing and cooling of gases, and extinguishing fires.

Notwithstanding the advances in the art and the attempts to create a system which will produce a uniform distribution of droplets having small droplet diameters, a need exists for a nozzle design which will further reduce the droplet size and increase the distribution thereof. As will be discussed in detail below, the presently disclosed colliding-jet nozzle provides such improvements. The nozzle will likely find application in technologies such as, for example, fire suppression, evaporative cooling and fuel injection.

SUMMARY OF THE DISCLOSURE

The present disclosure is directed to a nozzle design which is configured and dimensioned to cause the collision of two streams of fluid to yield a distribution of fluid droplets having advantageously small droplet diameters.

More particularly, the present disclosure is directed towards a colliding-jet nozzle which includes a nozzle body portion having a proximal end, a distal end and a fluid inlet defined partially therethrough and between the distal and proximal ends. Preferably, the nozzle body portion includes first and second outlet ports disposed through the nozzle body portion for directing fluid from the fluid inlet outwardly therefrom. A proximal end of a first hollow tube is attached and in fluid communication with the first outlet port and a distal end of the first hollow tube extends outwardly therefrom. A first end of a second hollow tube is attached and in fluid communication with the second outlet port and a second end of the second hollow tube is axially aligned with the distal end of the first hollow tube and spaced therefrom to define a gap therebetween such that fluid exiting from the first outlet port and fluid exiting from the second outlet port collide at a location within the gap to atomize fluid.

In one embodiment, the colliding-jet nozzle is provided with a cylindrical nozzle body portion having an inlet port and two outlet ports. A hollow tube assembly is fixedly attached to one of the two outlet ports, and is configured to be substantially C-shaped having a radius which directs fluid from this outlet port towards the other outlet port. Thus, two streams of fluid are formed, one exiting from each outlet port, which are caused to directly collide with each other to atomize the fluid.

In another embodiment of the presently disclosed colliding-jet nozzle, a pressure equalizing plate may be installed to optimize the performance of the nozzle.

The present disclosure is also directed towards methods of manufacturing colliding-jet nozzles wherein one such method includes the steps of: providing a body portion having distal and proximal ends and a hollow tube assembly having a first end and a second end; boring a fluid inlet in the nozzle body portion; boring a first outlet port and a second outlet port through the nozzle body portion to the fluid inlet; bending the hollow tube assembly to form a substantially C-shaped tube; attaching the first end of the hollow tube assembly in fluid communication with the second outlet port; attaching the second end of the hollow tube assembly in fluid communication with the first outlet port; and removing a portion of the hollow tube assembly to form a gap between two remaining segments of the hollow tube assembly. Preferably, an electric discharge machine removes a portion of the hollow tube assembly to form a gap in the range of about 0.001 inches to about 0.050 inches. Advantageously, the method further comprises the step of subjecting the hollow tube assembly to a thermal stress relief process to eliminate spring in the hollow tube assembly.

These and other objects, features and advantages of the present disclosure will become apparent from the following detailed description of illustrative embodiments, which is to be read in connection with the accompanying drawings.

BRIEF DESCRIPTION OF THE DRAWINGS

For a better understanding of the disclosure, reference is made to the following description of exemplary embodiments thereof, and to the accompanying drawings, wherein.

DETAILED DESCRIPTION OF THE DRAWINGS

Figure 1A:
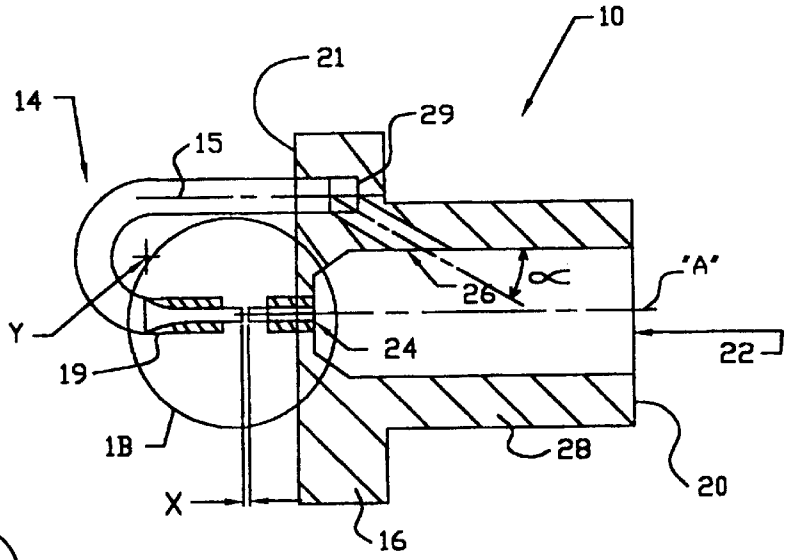
FIG. 1A is a side view in partial cross-section illustrating one embodiment of a colliding-jet nozzle in accordance with the present disclosure.
Figure 1B:
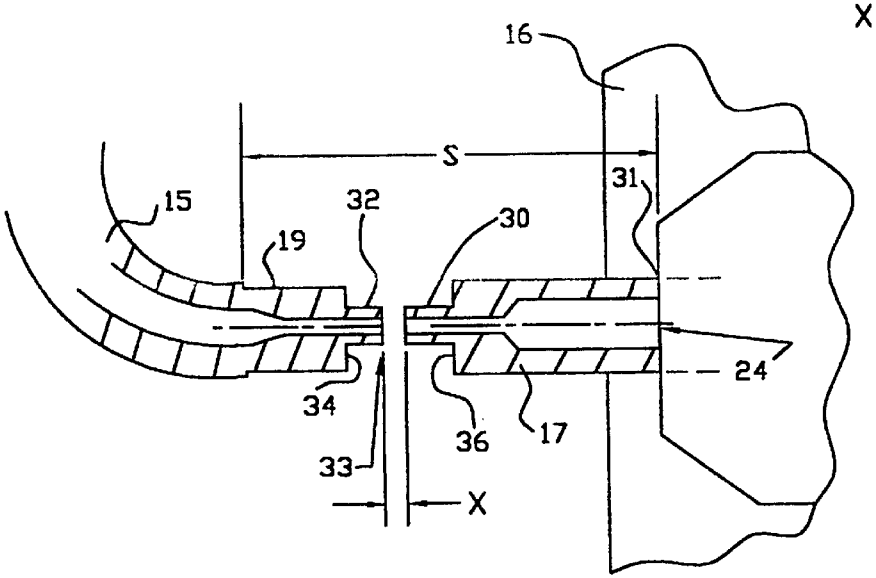
FIG. 1B is an enlarged, side view of the encircled area of FIG. 1A.

Referring initially to FIGS. 1A and 1B, a preferred embodiment of the colliding-jet nozzle 10 includes a cylindrical nozzle body portion 28 having an inlet port 22 and first and second outlet ports 24 and 26 located therethrough. Preferably, nozzle body portion 28 is formed as a hex plug, however, in some cases it may be desirable to manufacture nozzle portion 28 with a different shape, e.g., square or octagonal, depending upon a particular purpose. Inlet port 22 is located in a proximal end 20 of nozzle body portion 28 and is substantially larger in diameter than either of the first and second outlet ports 24 and 26. It is envisioned that a plurality of inlet ports 22 can be located on the nozzle body portion 28 such that different fluids can be combined/mixed and then atomized to meet a particular purpose.

The first outlet port 24 is located in a distal end 21 of nozzle body portion 28 and has a diameter of about 0.063 inches. The second outlet port 26 is located in a side portion of nozzle body portion 28 and has a diameter of about 0.063 inches. Preferably, second outlet 26 is disposed at an angle $\alpha$ relative to the longitudinal axis "A" of nozzle body portion 28. Colliding-jet nozzle 10 is preferably formed of stainless steel, but may be formed of any material capable of meeting the applicable design requirements (e.g., pressure and flow).

A hollow tube assembly 14 is fixedly attached (for example, by means of silver solder and/or brazing) at a first end 29 in second outlet port 26 within a flanged hex portion 16 of nozzle body 28. As seen best with respect to FIG. 1B, a second end 31 of hollow tube assembly 14 is also fixedly attached to first outlet port 24 within flanged hex portion 16. Preferably, hollow tube assembly 14 and first outlet port 24 are affixed at end 31 in fluid communication with one another and hollow tube assembly 14 and second outlet port 26 are affixed at end 29 in fluid communication with one another.

Tube assembly 14 comprises a stainless steel tubing portion 15 having an outside diameter of about 0.063 inch and a wall thickness of about 0.006 inches. Tube assembly 14 also includes a swaged end portion 19 defined by reference line "S" which has a different, i.e., smaller or larger, outside diameter than tube portion 15. In some cases it may be preferable to manufacture tube assembly 14 with varying internal diameters, e.g., proximate swaged end 19 or notch 33, to vary the speed and/or pressure of the fluid exiting the hollow tube assembly 14. Tube assembly 14 also includes tube portion 17 which extends outwardly from the distal end 16 of nozzle portion 28. In one embodiment, tube assembly 14 is configured to be substantially C-shaped to direct a stream of fluid from second outlet port 26 directly towards, and in axial alignment with, first outlet port 24. Preferably tube assembly 14 has a radius "Y" which is about 0.085 inches to about 0.100 inches and forms the substantial C-shape.

As seen best with respect to FIG. 1B, gap X can be formed by electric discharge machining (EDM) a portion of tube assembly 14 subsequent to it being soldered to first and second outlet ports 24, 26. More particularly, after tube assembly 14 is fixedly attached to port 24 and end 31 is axially aligned and fixedly attached to port 26, a notch or machine step 33, as defined by shoulders 34 and 36, is formed in tube assembly 14. A gap X, which is preferably in the range of about 0.001 inches to about 0.050 inches, is then cut by electric discharge machining a portion of the tube assembly between shoulders 34 and 36 thus creating two end tips 30 and 32 which are in precise axial alignment with one another. Proper alignment of the distal ends 30, 32 of the two colliding jets is critical to the successful operation of the colliding-jet nozzle 10. Therefore, as disclosed, fluid entering inlet port 22 is directed through each of the first and second outlet ports 24 and 26 thereby forming two streams which are caused to directly collide with each other to atomize the fluid at gap X.

Gap X can also be formed by attaching tube portion 17 of hollow tube assembly 14 in fluid communication with the first outlet port 24 such that the distal end 30 of the tube portion 17 extends outwardly therefrom. End 29 of tube portion 15 of hollow tube assembly 14 is then attached to the second outlet port 26 and end 32 of the tube portion 15 is axially aligned with end 30 of tube portion 17 so as to define a gap X therebetween.

The present disclosure also relates to methods of manufacturing colliding-jet nozzles. In particular, the colliding-jet nozzle 10 described above is typically manufactured in the following manner: providing a body portion 28 having distal and proximal ends 21 and 20, respectively, and a hollow tube assembly 14 having a first end 29 and a second end 31; boring a fluid inlet 22 in the nozzle body portion 28; boring a first outlet port 24 and a second outlet port 26 through the nozzle body portion to the fluid inlet 22; bending the hollow tube assembly 14 to form a substantially C-shaped tube; attaching the first end 29 of the hollow tube assembly 14 in fluid communication with the second outlet port 26; attaching the second end 31 of the hollow tube assembly 14 in fluid communication with the first outlet port 24; and removing a portion of the hollow tube assembly 14 to form a gap X between two remaining segments of the hollow tube assembly 14.

A further step includes machining notch 33 in the tube assembly 14 prior to removing the portion of the hollow tube assembly 14 to form gap X. Preferably, notch 33 is cut between shoulders 34 and 36. The hollow tube assembly 14 and the nozzle body portion 28 can also be surface treated with a phosphoric acid, or some other chemical, to minimize/prevent corrosion. Also, hollow tube assembly 14 can be subjected to a thermal stress relief process subsequent to the bending step, to eliminate any spring in the tube 14 which would cause a misalignment of distal ends 30 and 32 after gap X is formed.

Figure 2A:
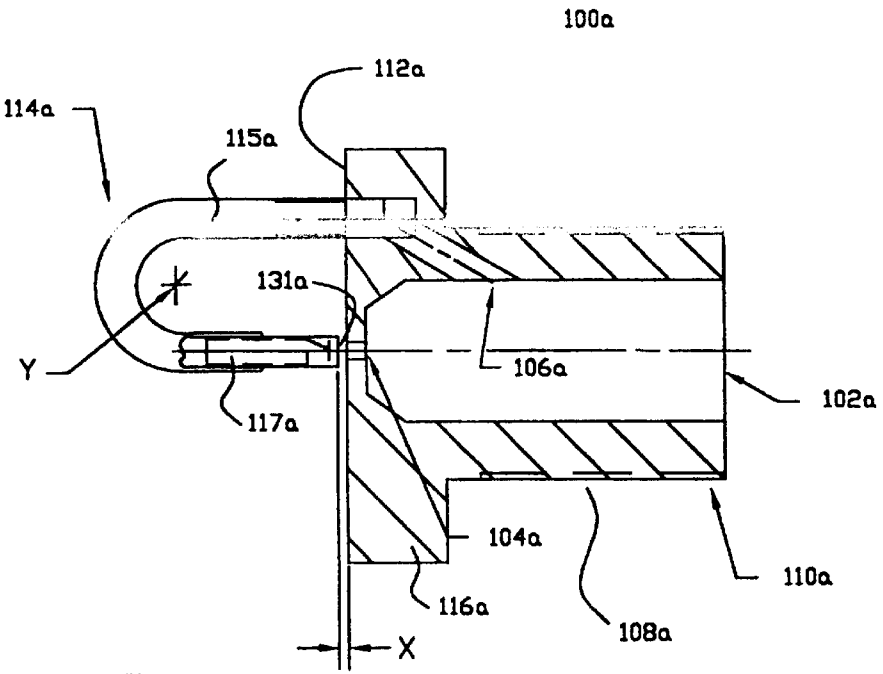
FIG. 2A is a side view in partial cross-section illustrating another embodiment of the colliding-jet nozzle in accordance with the present disclosure.
Figure 2B:
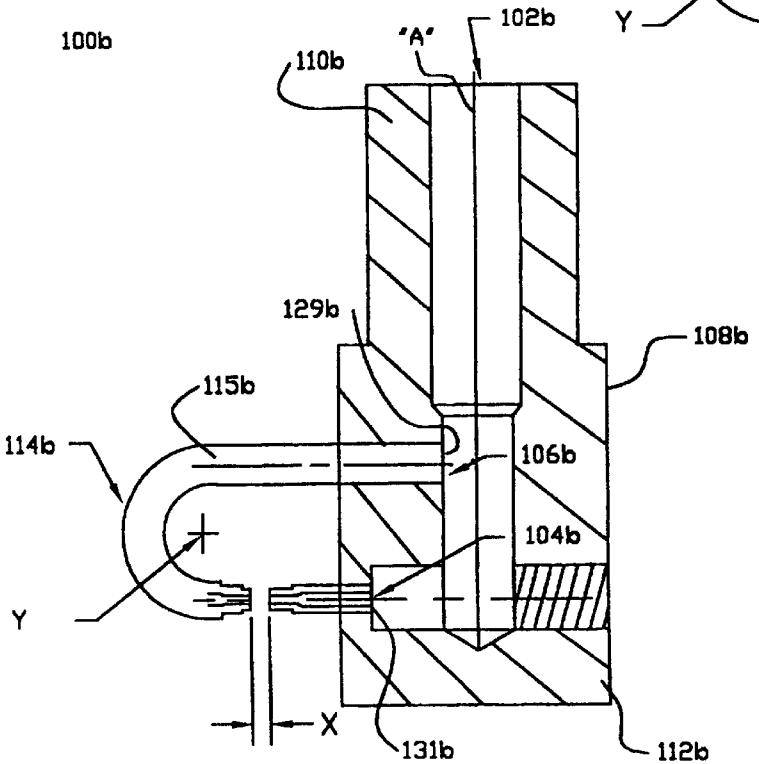
FIG. 2B is a side view in partial cross-section illustrating another embodiment of the colliding-jet nozzle wherein the hollow tube assembly is disposed at a 90° angle relative to the nozzle body portion.

Referring now to FIGS. 2A and 2B which disclose other embodiments of the colliding-jet nozzle 100*a* and 100*b*, respectively. More particularly, FIG. 2A discloses a colliding-jet nozzle 100*a* having a cylindrical nozzle body portion 108*a* similar to the nozzle body portion 28 disclosed with respect to FIG. 1A above, i.e., body portion 108*a* having a proximal end 110*a*, a distal end 112*a*, an inlet port 102*a* and first and second outlet ports 104*a* and 106*a*. Preferably, first outlet port 104*a* is located in distal end 112*a* of nozzle body portion 108*a* and has a diameter of about 0.005 inches and second outlet port 106*a* is located in a side of nozzle body portion 108*a* and has a diameter of about 0.063 inches.

Hollow tube assembly 114*a* is fixedly attached in second outlet port 106*a* in flanged portion 116*a* and is in fluid communication with second outlet port 106*a*. Tube assembly 114*a* includes a stainless steel tubing portion 115*a* having a 0.063 inch outside diameter and a 0.006 inch wall thickness, and a male/female stainless steel portion 117*a* having a 0.050 inch outside diameter. Preferably, tube assembly 114*a* is substantially C-shaped and has a radius "Y" which directs a stream of fluid from second outlet port 106*a* directly towards, and in axial alignment with, first outlet port 104*a*. Gap X is formed (preferably by electric discharge machining a portion of tube assembly 114*a*) between first outlet port 104*a* and the outlet end 131*a* of tube assembly 114*a*. Again, proper alignment of the fluid stream exiting port 104*a* and the fluid stream exiting distal end 131*a* of tube assembly 114*a* is critical to the successful operation of the colliding-jet nozzle.

FIG. 2B discloses another embodiment of a colliding-jet nozzle 100*b* wherein the stream of fluid is atomized on the side or at an angle of about 90° from the nozzle body portion 108*b*. More particularly, this version of the colliding-jet nozzle 100*b* includes a first outlet port 104*b* disposed about 90° from the distal end 112*b* of nozzle portion 108*b* and a second outlet port 106*b* located in the side of nozzle body portion 108*b*. Both the first and the second outlet ports 104*b* and 106*b*, respectively, have diameters of about 0.063 inches. Preferably, both ports 104*a* and 106*a* direct a stream of fluid at about an angle of 90° from central axis "A" of nozzle body portion 108*b*. A hollow tube assembly 114*b* is fixedly attached at a first end 129*b* in second outlet port 106*b* within nozzle body 108*b*. A second end 131*b* of hollow tube assembly 114*b* is also fixedly attached to first outlet port 104*b* within nozzle body portion 108*b*. Preferably, second outlet port 106*b* and first outlet port 104*b* are both in fluid communication with tube assembly 114*b*.

A gap X is formed in a similar manner, e.g., EDM, as described with respect to FIGS. 1A and 1B. As can be appreciated, fluid entering inlet port 102*b* is directed at an angle of about 90° through each of the first and second outlet ports 104*b* and 106*b* thereby forming two fluid streams which are caused by the C-shaped tube assembly 114*b* to directly collide with each other to atomize the fluid in a dispersion pattern which is in substantially parallel relation to axis "A" of nozzle body portion 108*a*.

Figure 3A:
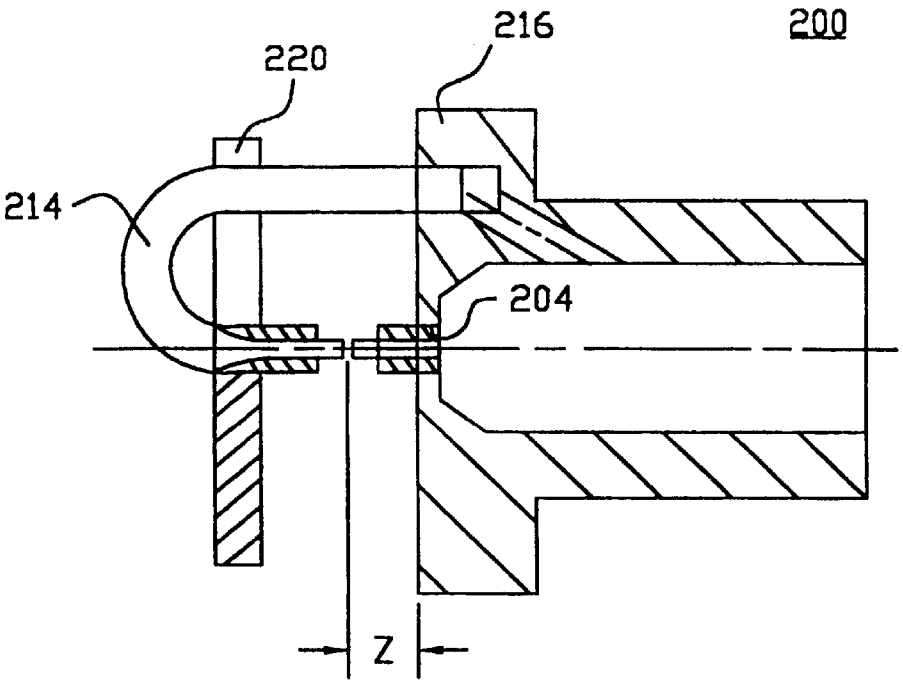
FIG. 3A is a side view in partial cross-section illustrating another embodiment of the colliding-jet nozzle in accordance with the present disclosure.
Figure 3B:
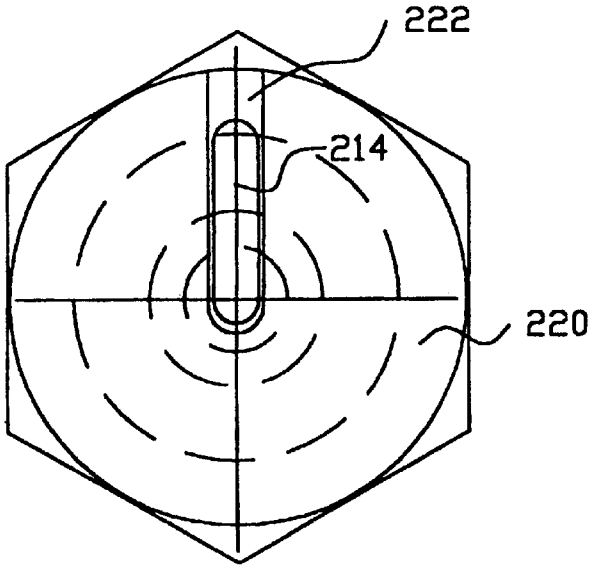
FIG. 3B is an end view of the colliding-jet nozzle of FIG. 3A.

FIGS. 3A and 3B illustrate another embodiment of the presently disclosed colliding-jet nozzle 200 which features a pressure equalizing plate 220 attached to tube assembly 214. Pressure equalizing plate 220 is preferably formed of a circular flat washer having a slot 222 formed therein which is configured and dimensioned to fit over tube assembly 214. The position of pressure equalizing plate 220 may be adjusted along the longitudinal axis of tube assembly 214 prior to being affixed thereto by spot-welding or any other suitable means known to one having ordinary skill in the art.

In certain applications, the droplet distribution produced by the colliding-jet nozzle embodiments illustrated in FIGS. 1A and 2A has been found to impinge upon the face of the distal flanged hex portion 116*a* of the nozzle body which may result in reduced performance of the nozzle. This is caused by a localized low pressure zone in the vicinity of the face of the nozzle. Experimentation has proven that the installation of pressure equalizing plate 220 will at least partially eliminate the detrimental effects of the low pressure zone and thereby optimize the performance of the colliding-jet nozzle. With the pressure equalizing plate 220 in place, the droplet distribution created by the colliding streams of fluid may be effectively narrowed down to a thin radial sheet. Thus, the drop distribution produced by the colliding-jet nozzle is optimized resulting in a reduction in droplet size.

Also, to further increase the effectiveness of the colliding streams of fluid to further reduce the droplet size and optimize the distribution, first outlet port 204 is disposed a predetermined distance "Z" away from the face of flanged hex portion 216. Distance "Z" is preferably in the range of about 0.085 inches to about 0.095 inches.

As will be discussed in further detail below, the configuration of the presently disclosed embodiments of a colliding-jet nozzle advantageously provide a high liquid flow rate, for example in the range of about 5 gallons per hour (gph) to about 25 gph, while producing a droplet distribution having a mass median particle diameter dimension in the range of about 22 microns to about 25 microns.

An intended use of the presently disclosed colliding-jet nozzle is the evaporative cooling of the inlet air to a gas turbine. The evaporation of fine droplets of fluid in an air stream cools the air by extracting the latent heat needed for the evaporation. The resulting mixture of air and fluid is at a lower temperature and higher density, thus resulting in an increased mass flow rate to the gas turbine. Increased mass flow results in increased turbine power output.

To improve the efficiency of the cooling effect, the evaporative rate of the fluid must be maximized. The amount and rate of evaporation are a function of the ambient relative humidity, temperature, droplet size and the residence time of the droplets in the air stream. For example, based on complete evaporation, a 3% increase in work output may be possible on a 90° F., 70% humidity day with a 7.5° F. temperature drop. The droplet distribution is therefore an important factor in the rate of evaporation and nozzle performance and design. The presently disclosed colliding-jet nozzle is designed to form a radial sheet of particles perpendicular to the main air flow. The penetration of particles and the distance they travel in the perpendicular or lateral direction is a function of mass, particle velocity, air velocity, and angles of discharge.

In the evaporate cooling application, a condition known as "overspray" must be evaluated to ensure that any detrimental effects resulting therefrom are minimized. Overspray is defined as that amount of fluid that is injected into the air stream which is in excess of the amount of fluid necessary to bring the unsaturated air (ambient air) to its saturation point. The cooling effect along the compressor path vs. overspray ratio may be evaluated to predict the reduction in compressor work which may be expected due to overspray. In the gas turbine application, the amount of fluid and particle size injected into the air stream must be limited to minimize deleterious effects to the turbine, such as blade erosion. Further, evaporative intra-cooling, that is cooling within the compressor, especially in the early stages, reduces the compressor work and thereby reduces the heat rate (increases the fuel efficiency). This is made possible by the use of the presently disclosed colliding-jet nozzle with its selection of particle size and distribution pattern.

To optimize the colliding jet nozzle design, experimentation and testing was performed to examine the droplet trajectories at various angles and particle velocities for a specific design air velocity of an evaporative cooler inlet. The testing was designed to illustrate the droplet distribution achieved in the radial direction prior to reaching the air flow velocity and direction.

Figure 4:
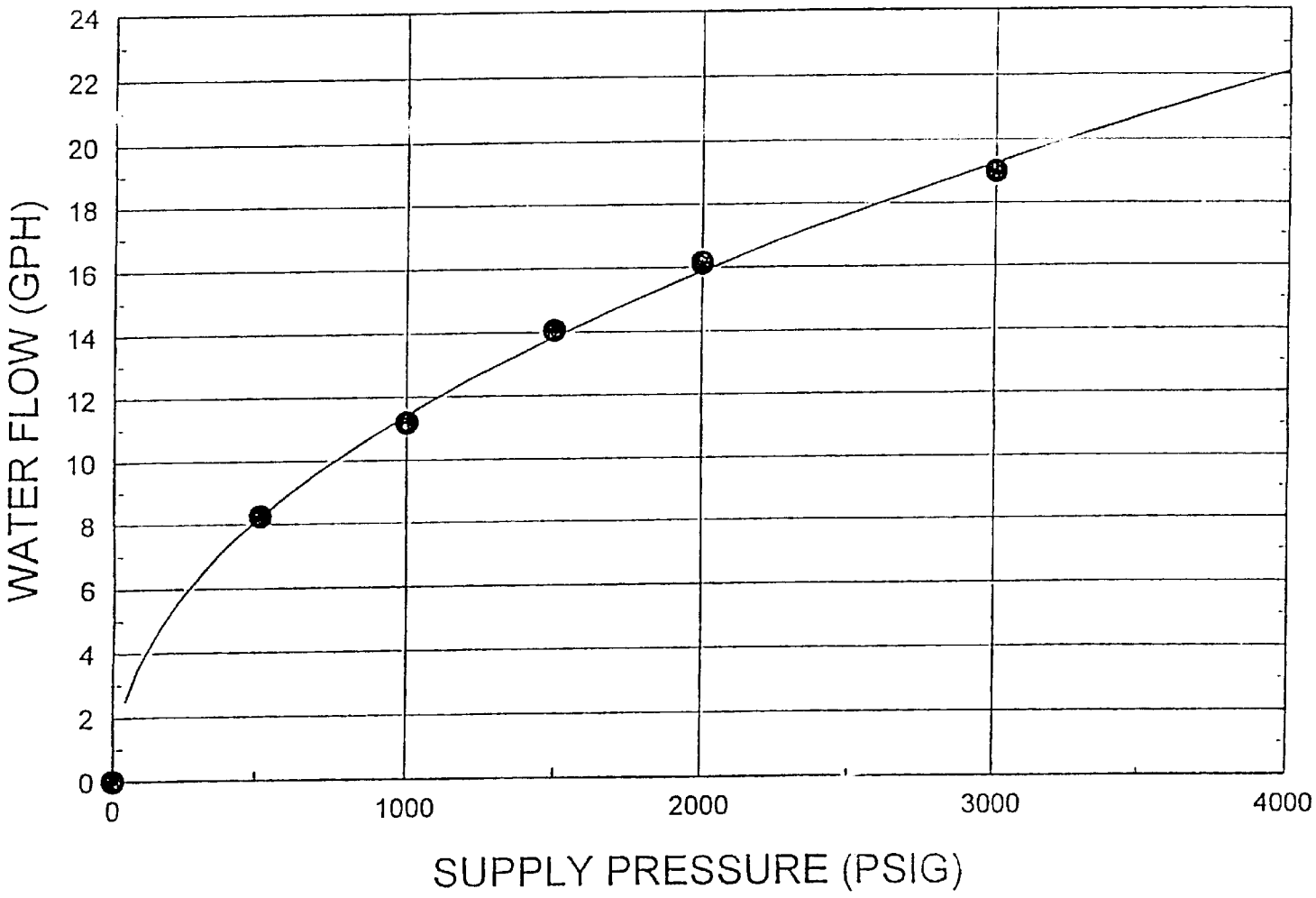
FIG. 4 is a graphical representation of the flow characteristic of a colliding-jet nozzle illustrating fluid flow as a function of supply pressure.
Figure 5:
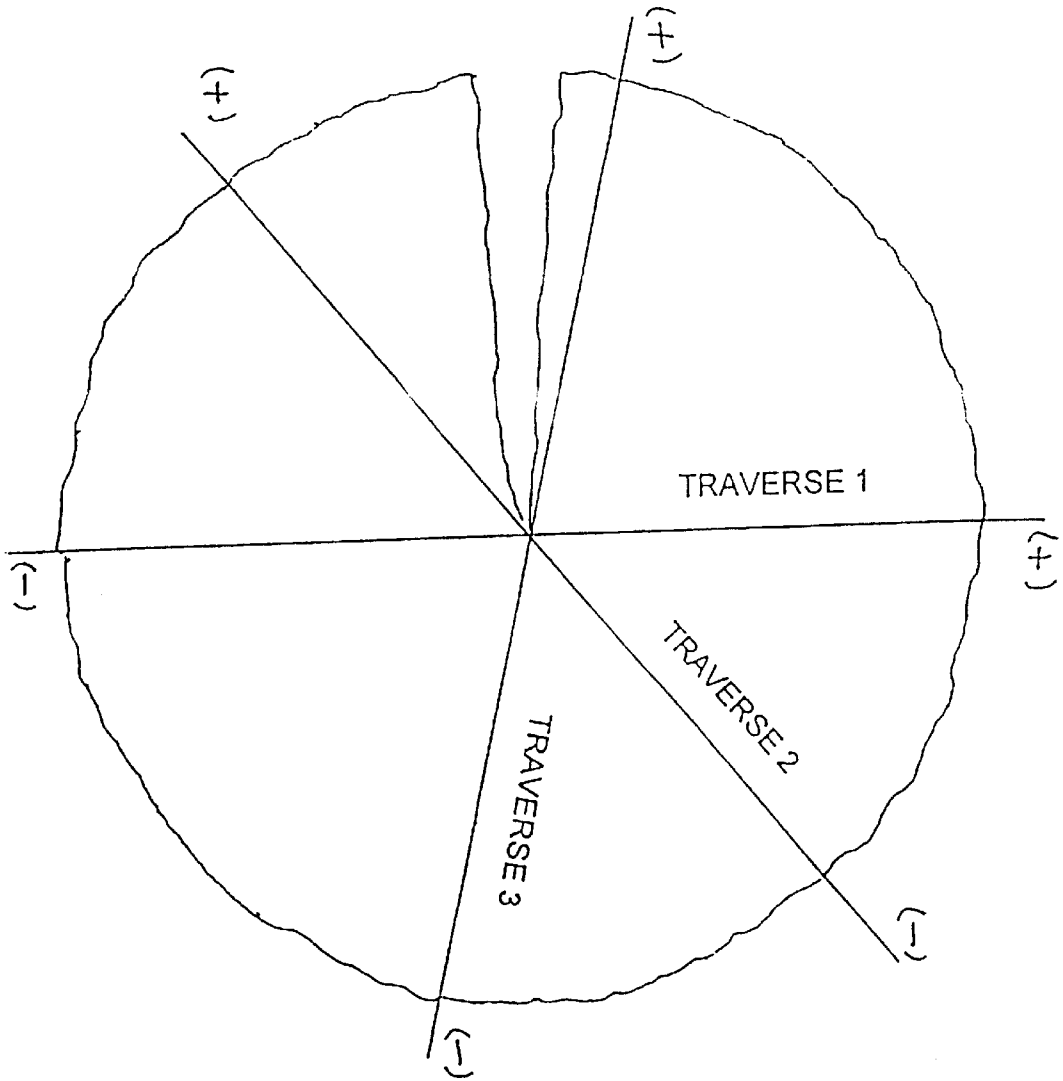
FIG. 5 is a top view of a droplet distribution illustrating the position of laser traverse lines taken therethrough.

As illustrated graphically in FIG. 4, the presently disclosed colliding-jet nozzle was tested at different fluid flow rates and corresponding supply pressures. The flow rates are shown on the vertical axis and the supply pressures are shown on the horizontal axis. The resulting particle distribution was evaluated by traversing the distribution with laser refraction equipment (laser phase doppler or photo-imaging equipment may also be used), along three traverse lines as shown in FIG. 5.

Figure 6:
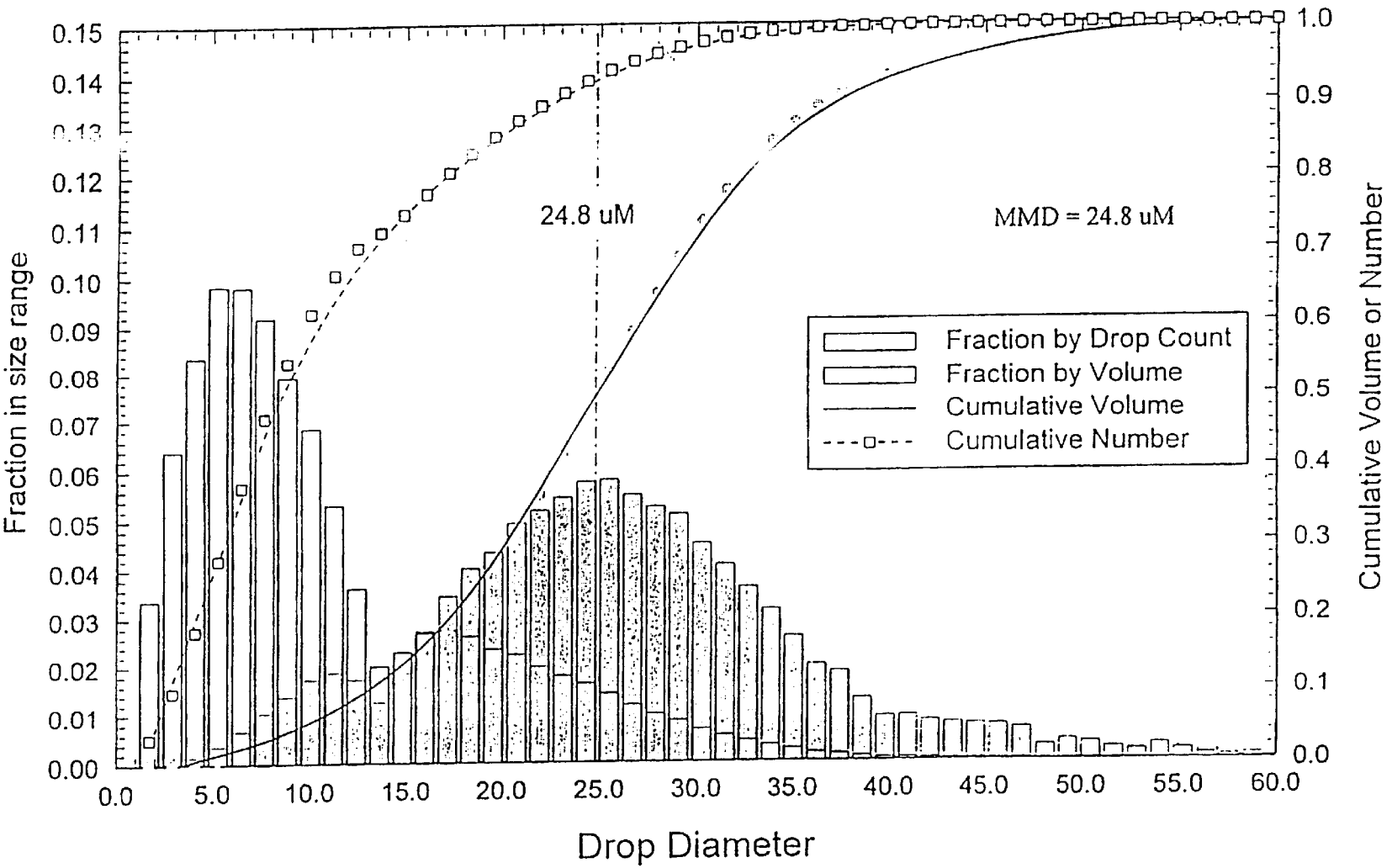
FIG. 6 is a graphical representation of a droplet size distribution along traverse 1 at 3000 psig and 19 gallons per hour (gph)
Figure 7:
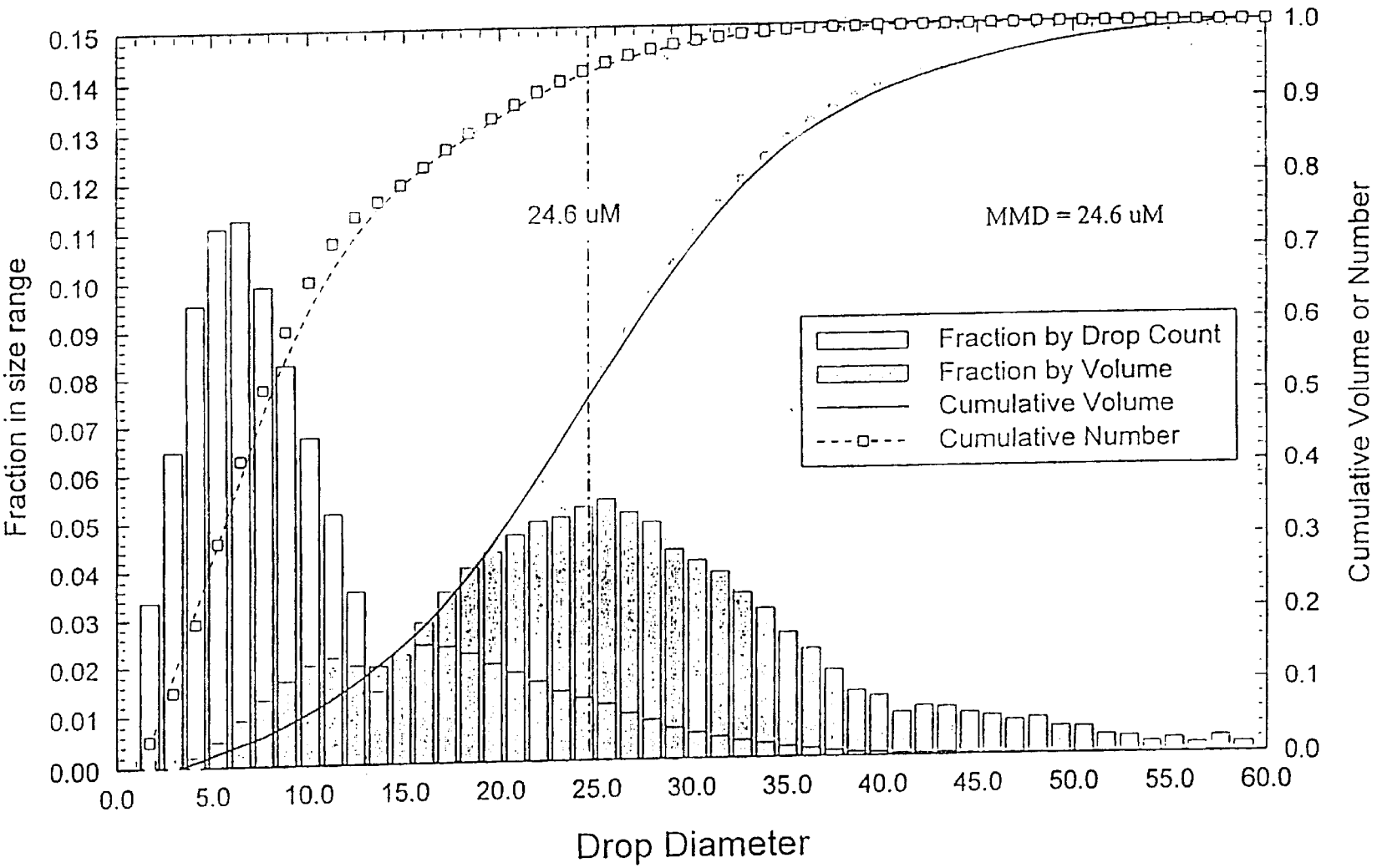
FIG. 7 is a graphical representation of a drop size distribution along traverse 2 at 3000 psig and 19 gph.
Figure 8:
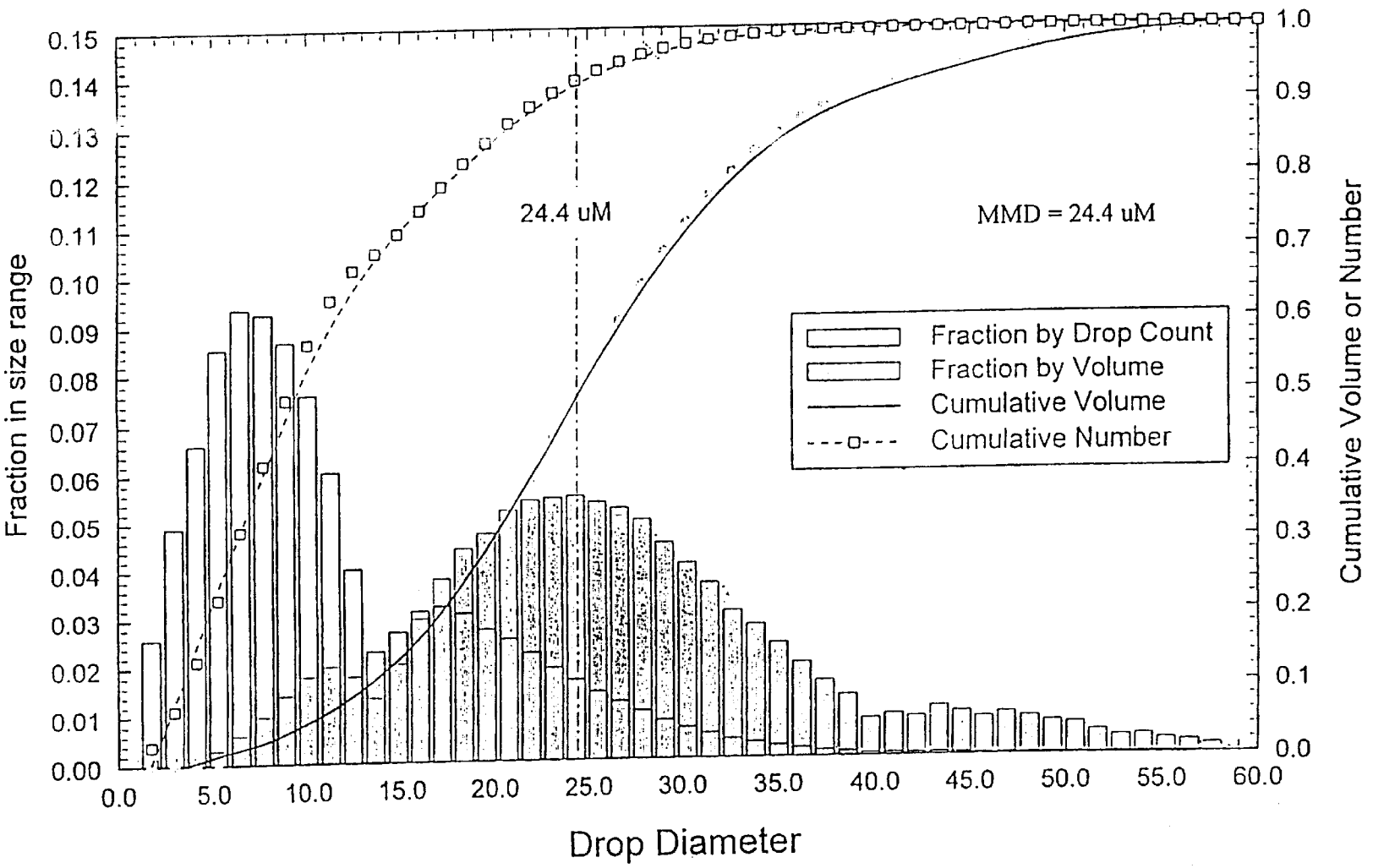
FIG. 8 is a graphical representation of a drop size distribution along traverse 3 at 3000 psig and 19 gph.
Figure 9:
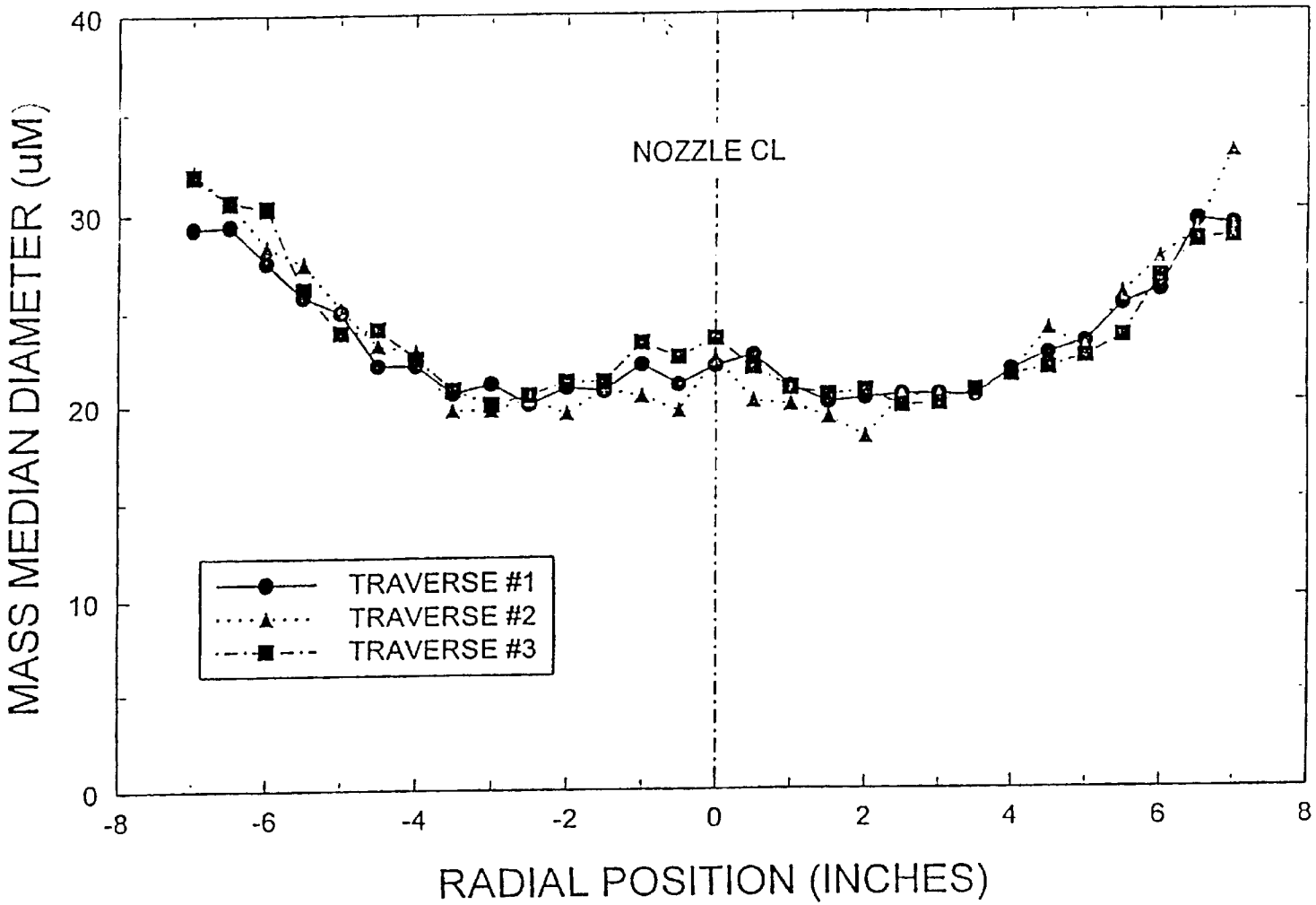
FIG. 9 is a graphical representation of the measured mass median as a function of the radial position in the droplet distribution at 3000 psig.

The drop size distribution was then plotted as illustrated in FIGS. 6–8. FIGS. 6–8 represent the drop size distribution at a supply pressure of 3000 psig and a flow rate of 19 gallons/hour (gph), at each of the three traverse positions. Each of FIGS. 6–8 illustrates the fraction by drop count and volume as a bar chart, and the cumulative volume and cumulative number as a line chart. At a 3000 psig supply pressure and 19 gph flow rate, the mass median drop diameter was 24.8 $\mu$m along traverse 1, 24.6 $\mu$m along traverse 2 and 24.4 $\mu$m along traverse 3. FIG. 9 illustrates the measured mass median as a function of the radial position in the spray at a supply pressure of 3000 psig for each of the three traverse positions.

Figure 10:
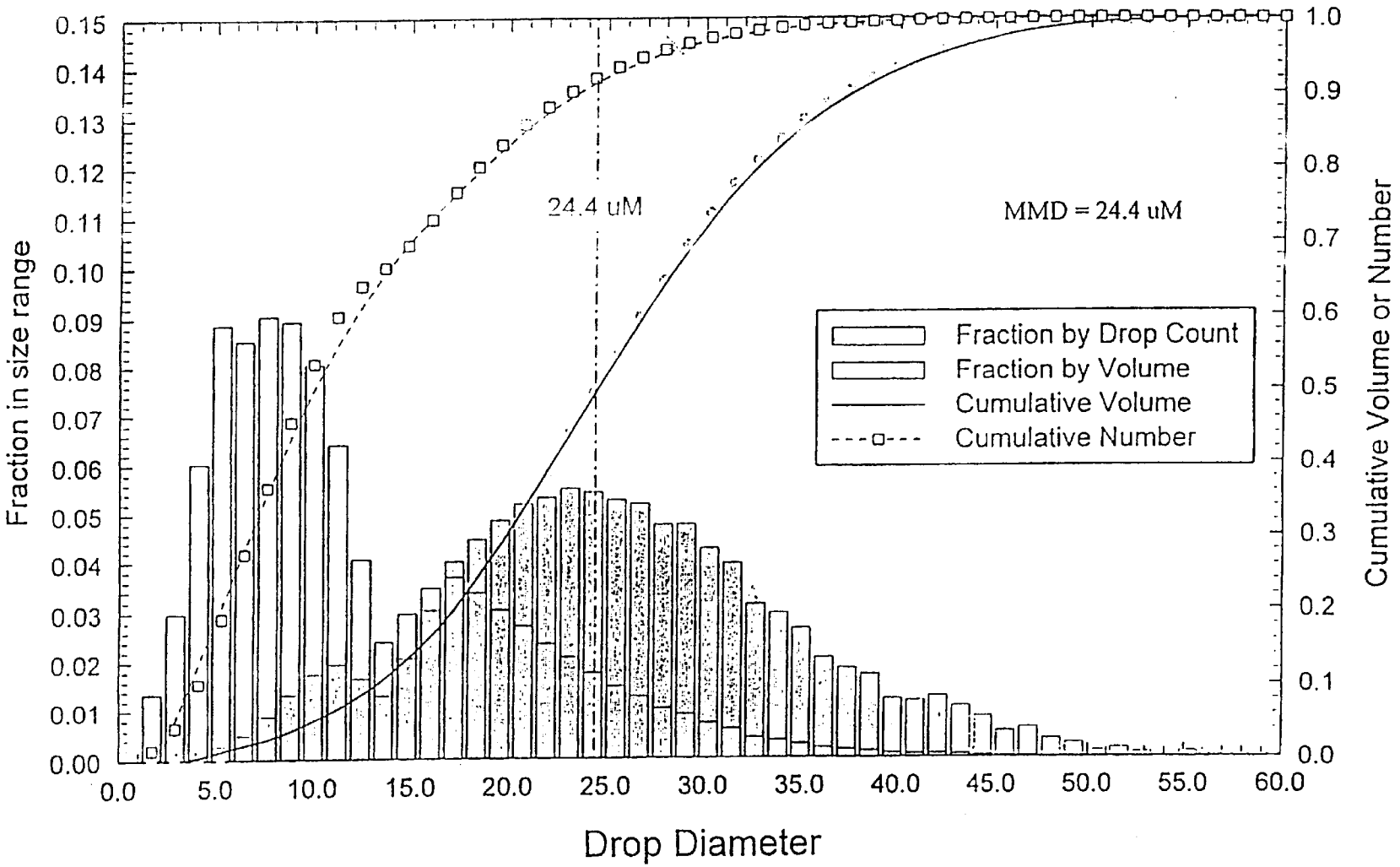
FIG. 10 is a graphical representation of a drop size distribution along traverse 1 at 1500 psig and 14.1 gph.
Figure 11:
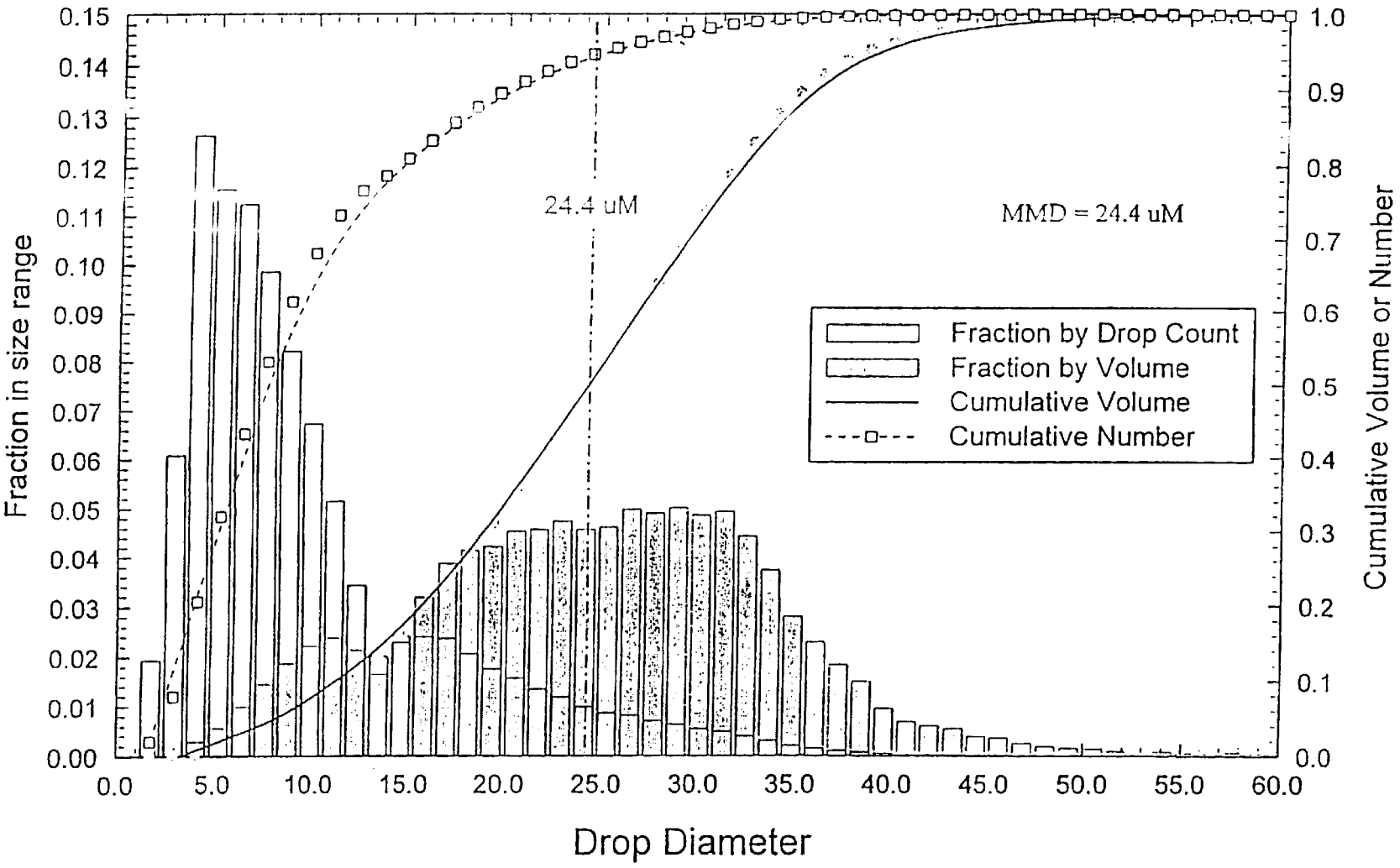
FIG. 11 is a graphical representation of a drop size distribution along traverse 2 at 1500 psig and 14.1 gph.
Figure 12:
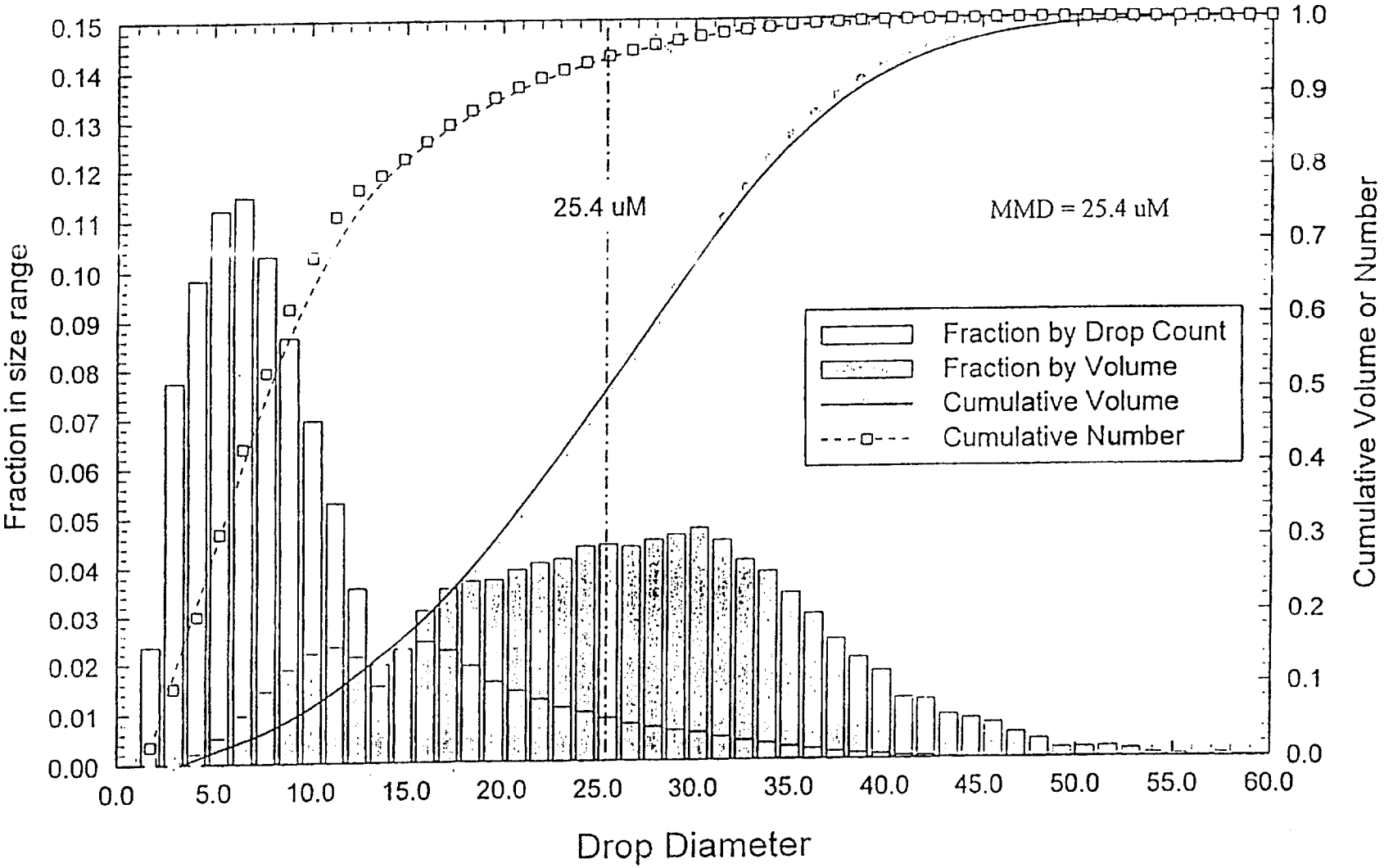
FIG. 12 is a graphical representation of a drop size distribution along traverse 3 at 1500 psig and 14.1 gph.
Figure 13:
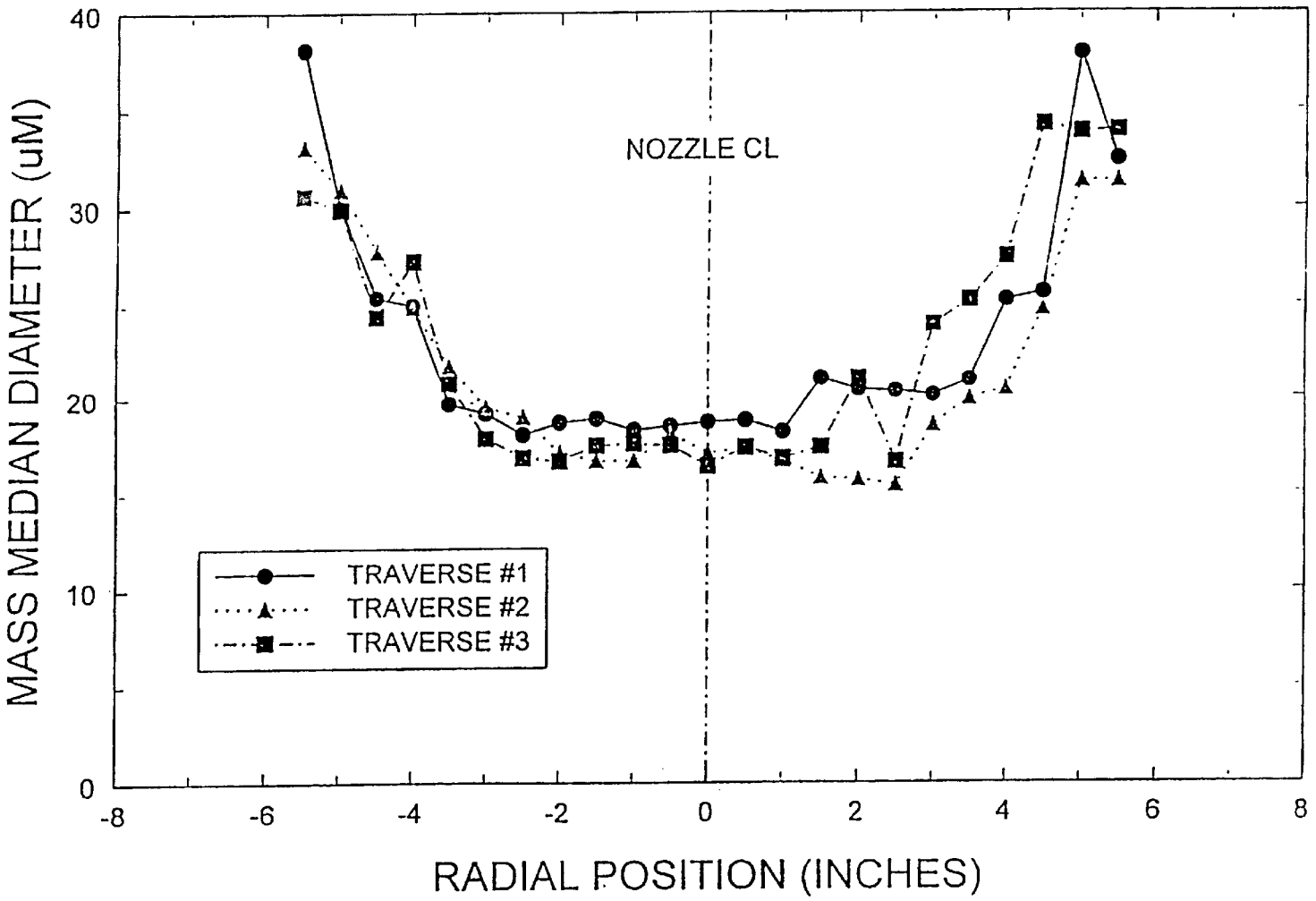
FIG. 13 is a graphical representation of the measured mass median as a function of the radial position in the droplet distribution at 1500 psig.

The drop size distribution was also plotted as illustrated in FIGS. 10–12. FIGS. 10–12 represent the drop size distribution at a supply pressure of 1500 psig and a flow rate of 14.1 gallons/hour, at each of the three traverse positions. Each of FIGS. 10–12 illustrates the fraction by drop count and volume as a bar chart, and the cumulative volume and cumulative number as a line chart. At a 1500 psig supply pressure and 14.1 gph flow rate, the mass median drop diameter was 24.4 $\mu$m along traverse 1, 24.4 $\mu$m along traverse 2 and 25.4 $\mu$m along traverse 3. FIG. 13 illustrates the measured mass median as a function of the radial position in the spray at a supply pressure of 1500 psig.

Figure 14:
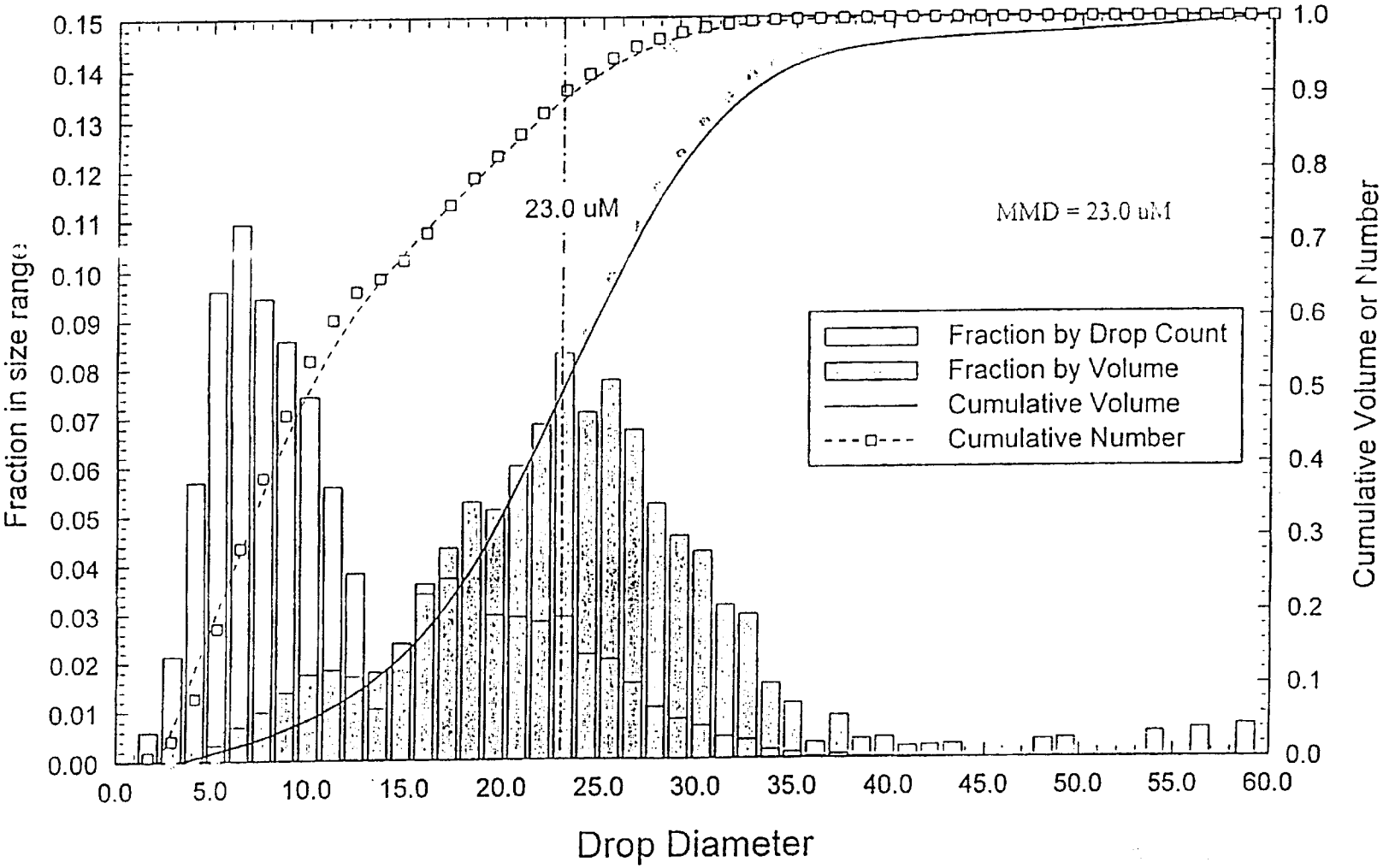
FIG. 14 is a graphical representation of a drop size distribution along traverse 1 at 500 psig and 8.0 gph.

FIG. 14 represents the drop size distribution at a supply pressure of 500 psig and a corresponding flow rate of 8.0 gallons/hour at one traverse position. At a 500 psig supply pressure and 8.0 gph flow rate, the mass median drop diameter was 23.0 $\mu$m.

Figure 17:
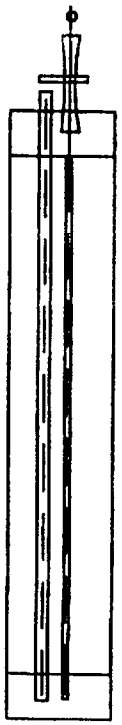
FIG. 17 is another side view of the assembly of FIG. 15 taken in the direction of arrows B—B in FIG. 15.
Figure 15:
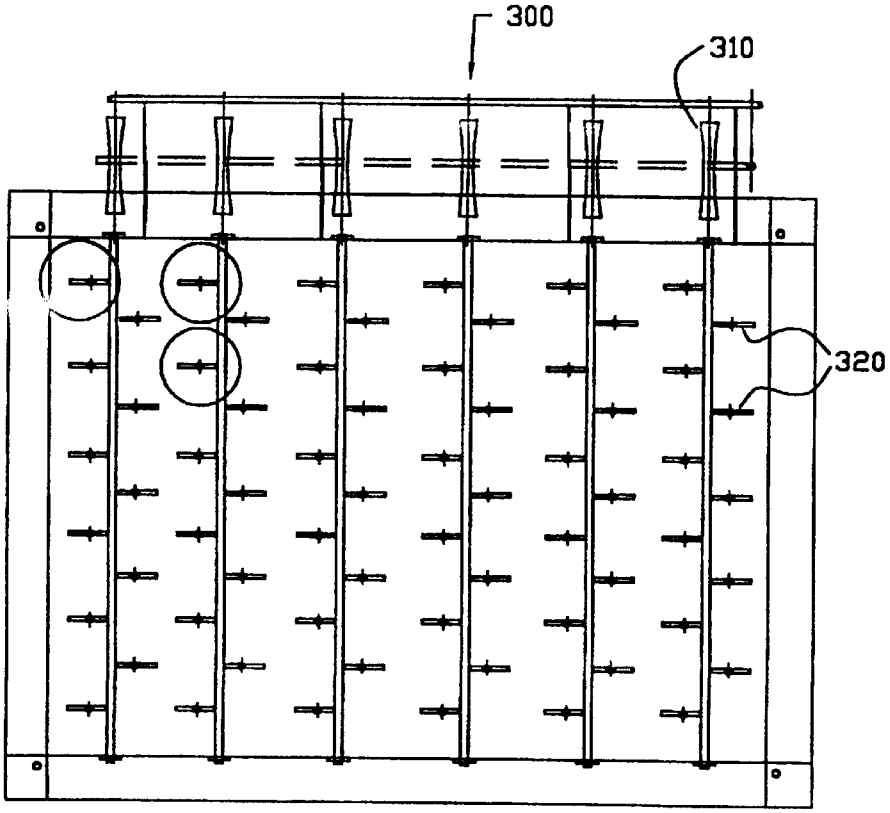
FIG. 15 is a plan view of an evaporative cooler assembly for installation on a gas turbine inlet plenum.
Figure 16:
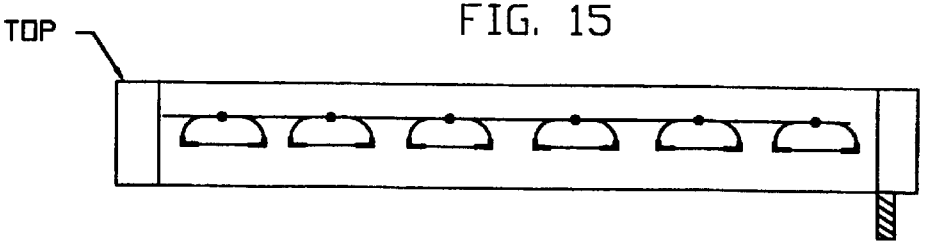
FIG. 16 is a side view of the assembly of FIG. 15 taken in the direction of arrows A—A in FIG. 15.

To perform field testing of the presently disclosed colliding-jet nozzle in a gas turbine inlet evaporative cooling application, an assembly 300 was fabricated as illustrated in FIGS. 15–17. Assembly 300 was fabricated with computerized bending brakes and the hole patterns were accurately located. The fluid feeder tubes 310, preferably formed of stainless steel, were fabricated with special couplings which were silver soldered in place. The couplings to which the nozzles 320 are connected were designed to withstand the reaction force from a high pressure nozzle.

The fluid system was designed for pressures up to 4000 psi and structurally such that typical movement or vibration would not cause the fittings to become uncoupled. Assembly 300 was installed on the inlet plenum of an industrial type gas turbine unit. Sixty-six colliding-jet nozzles 320 in accordance with the present disclosure were installed within the assembly to facilitate distribution of a fluid spray into the compressor plenum. The nozzles may be connected to the assembly by means of a soldered, welded, screwed or other suitable attachment means as known to one having ordinary skill in the art. Sixty-six nozzles at a design flow of approximately 12 gph resulted in a total flow of approximately 792 gph or 13.2 gpm at 1200 psig. The testing yielded an approximate ten percent power boost.

Another use of the presently disclosed colliding-jet nozzle may be appreciated in the fire suppression technology. Factory Mutual Research Corporation (FMRC) acknowledged the benefits of using fine fluid spray fire suppression systems in certain applications in a 1996 FMRC Update, volume 10, number 1, which is incorporated herein by reference. Fine fluid spray systems are designed to generate a mist or fog of small fluid droplets. The primary extinguishing mechanism is one in which the droplets are vaporized by the heat of the fire and converted into steam. The steam is then used as an inerting agent to extinguish the fire. Research has shown that there is an optimum droplet size, of about 142$\mu$ which minimizes fluid flow requirements, extinguishes the fire, and reduces the chance of fluid damage which is typical in certain applications using conventional sprinkler systems. By lowering the pressure to the colliding-jet nozzle so that it operates within a typical fire hydrant pressure range, the optimum droplet size is achievable. Therefore, the droplet size generated by the disclosed colliding-jet nozzle will improve the ability to suppress fires by means of a fine fluid spray system.

Although the illustrative embodiments of the present disclosure have been described herein with reference to the accompanying drawings, it is to be understood that the disclosure is not limited to those precise embodiments, and that various other changes and modifications may be affected therein by one skilled in the art without departing from the scope or spirit of the disclosure. All such changes and modifications are intended to be included within the scope of the disclosure as defined by the appended claims.

What is claimed is:

1. A colliding-jet nozzle comprising:

a nozzle body portion having a proximal end, a distal end and at least one inlet formed at least partially therethrough between said distal end and said proximal end, said nozzle body portion including first and second outlet ports disposed through said nozzle body portion for directing fluid from said inlet outwardly therefrom;

a first hollow tube having a proximal end and a distal end, said proximal end attached and in fluid communication with said first outlet port and said distal end extending outwardly therefrom; and a second hollow tube having first and second ends, said first end attached and in fluid communication with said second outlet port, said distal end of said first hollow tube and said second end of said second hollow tube being uniformly configured and dimensioned, wherein said second end is axially aligned with said distal end of said first hollow tube and spaced apart therefrom to define a gap therebetween such that fluid exiting from said first outlet port and fluid exiting from said second outlet port collide at a location within said gap to atomize fluid wherein said distal end of said first hollow tube and said second end of said second hollow tube are disposed substantially orthogonal to said nozzle body portion.

2. The colliding-jet nozzle according to claim 1 wherein said gap in said hollow tube assembly is in a range of about 0.001 inches to about 0.050 inches.

3. The colliding-jet nozzle according to claim 1 wherein said first and second hollow tubes and said nozzle portion are surface treated with phosphoric acid to minimize corrosion.

4. The colliding-jet nozzle according to claim 1 wherein said nozzle body portion comprises a hexagonal-shaped plug.

5. The colliding-jet nozzle according to claim 1 wherein one of said first and second hollow tubes is substantially C-shaped.

6. The colliding-jet nozzle according to claim 1 wherein said proximal end of said first hollow tube and said first end of said second hollow tube are attached to said outlet ports of said nozzle body portion by soldering.

7. A colliding-jet nozzle comprising:

a nozzle body portion having a proximal end, a distal end and at least one inlet formed at least partially therethrough between said distal end and said proximal end, said nozzle body portion including first and second outlet ports disposed through said nozzle body portion for directing fluid from said inlet outwardly therefrom;

a first hollow tube having a proximal end and a distal end, said proximal end attached and in fluid communication with said first outlet port and said distal end extending outwardly therefrom; and a second hollow tube having first and second ends, said first end attached and in fluid communication with said second outlet port, said distal end of said first hollow tube and said second end of said second hollow tube being uniformly configured and dimensioned, wherein said second end is axially aligned with said distal end of said first hollow tube and spaced apart therefrom to define a gap therebetween such that fluid exiting from said first outlet port and fluid exiting from said second outlet port collide at a location within said gap to atomize fluid; and a pressure equalizing plate disposed distally from said first outlet port.

8. The colliding-jet nozzle according to claim 7 wherein said gap in said hollow tube assembly is in a range of about 0.001 inches to about 0.050 inches.

9. The colliding-jet nozzle according to claim 7 wherein said first and second hollow tubes and said nozzle portion are surface treated with phosphoric acid to minimize corrosion.

10. The colliding-jet nozzle according to claim 7 wherein said nozzle body portion comprises a hexagonal-shaped plug.

11. The colliding-jet nozzle according to claim 7 wherein one of said first and second hollow tubes is substantially C-shaped.

12. The colliding-jet nozzle according to claim 7 wherein said proximal end of said first hollow tube and said first end of said second hollow tube are attached to said outlet ports of said nozzle body portion by soldering.

13. A colliding-jet nozzle comprising:

a nozzle body portion having at least one inlet, a first outlet port and a second outlet port;

a substantially C-shaped hollow tube assembly attached to said second outlet port having a radius which directs a stream of fluid from the second outlet port towards the first outlet port such that the fluid exiting from the second outlet port is caused to collide with the fluid exiting the first outlet port to atomize the fluid; and a pressure equalizing plate disposed distally from said first outlet port.

14. The colliding-jet nozzle according to claim 13 wherein said equalizing plate is configured and dimensioned to fit over said hollow tube assembly such that the fluid is atomized between said equalizing plate and said first outlet port.

15. The colliding-jet nozzle according to claim 14 wherein said equalizing plate comprises a washer having a slot formed therein which is configured and dimensioned to fit over said hollow tube assembly.

* * * * *